US005680986A

United States Patent [19]

Botterman

[11] Patent Number: 5,680,986

[45] Date of Patent: Oct. 28, 1997

[54] CARTON WITH POUR SPOUT FORMED BY LINER

[75] Inventor: David L. Botterman, Arlington, Tex.

[73] Assignee: Jefferson Smurfit Corporation, Clayton, Mo.

[21] Appl. No.: 768,860

[22] Filed: Dec. 17, 1996

[51] Int. Cl.[6] ..... B65D 5/56; B65D 5/70

[52] U.S. Cl. ..... 229/215; 220/416; 229/207; 229/221

[58] Field of Search ..... 229/207, 214, 229/215, 217, 221, 223, 242, 243; 220/416, 418

[56] References Cited

U.S. PATENT DOCUMENTS

| | | | |
|---|---|---|---|
| 1,931,991 | 10/1933 | Mergentheim | 229/207 |
| 2,233,602 | 3/1941 | Greeley | 229/215 |
| 2,819,831 | 1/1958 | Polarek et al. | 229/221 |
| 2,820,585 | 1/1958 | Nerenberg et al. | 229/221 |
| 3,853,261 | 12/1974 | Moore | 229/207 |
| 4,809,853 | 3/1989 | Weber | 229/207 |
| 4,909,395 | 3/1990 | Weissman | 229/219 |
| 4,953,707 | 9/1990 | Wein | 229/207 |
| 4,953,781 | 9/1990 | Bryan | 229/215 |
| 5,044,503 | 9/1991 | Wein | 229/215 |
| 5,219,089 | 6/1993 | Kiolbasa et al. | 220/416 |
| 5,236,123 | 8/1993 | Stone et al. | 220/418 |
| 5,328,091 | 7/1994 | Koss | 229/231 |
| 5,344,066 | 9/1994 | Fogle | 220/416 |
| 5,518,174 | 5/1996 | Botterman | 220/416 |

FOREIGN PATENT DOCUMENTS

| | | | |
|---|---|---|---|
| 2124285 | 12/1971 | Germany | 229/215 |
| 510965 | 8/1939 | United Kingdom | 229/243 |
| 925975 | 5/1963 | United Kingdom | 229/221 |
| 2045723 | 11/1980 | United Kingdom | 229/221 |
| 9002689 | 3/1990 | WIPO | 229/221 |

*Primary Examiner*—Gary E. Elkins
*Attorney, Agent, or Firm*—Richard W. Carpenter

[57] ABSTRACT

A paperboard dispensing carton including an outer shell with a reclosable dispensing opening extending therethrough covered by a sift resistant opening flap and an inner liner with a pour spout formed therein and extendable through the dispensing opening.

20 Claims, 3 Drawing Sheets

CARTON WITH POUR SPOUT FORMED BY LINER

BACKGROUND OF THE INVENTION

1. Field of the Invention

This invention relates to lined dispensing cartons of the type used for the packaging of granular products, such as detergent, and more particularly to a paperboard carton with a reclosable dispensing opening, a pour spout formed by the carton liner and extendable through the opening, and a sift-resistant opening flap.

2. Description of the Background Art

A background art search directed to the subject matter of this invention conducted in the United States Patent and Trademark Office disclosed the following United States Letters Patent:

| | | | |
|---|---|---|---|
| 2,233,602 | 4,809,853 | 4,909,395 | 4,953,707 |
| 4,953,781 | 5,044,503 | 5,219,089 | 5,236,123 |
| 5,328,091 | | | |

None of the patents uncovered in the search discloses a lined dispensing carton with a dispensing opening, a pour spout formed by the carton liner and extendable through the dispensing opening, and a sift-resistant opening flap.

SUMMARY OF THE INVENTION

It is a primary object of the invention to provide a lined dispensing carton with a sift-resistant dispensing opening, a pour spout, and reclosure capacity.

A more specific object of the invention is to provide a carton of the type described wherein the pour spout is formed by the liner of the carton.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1A:
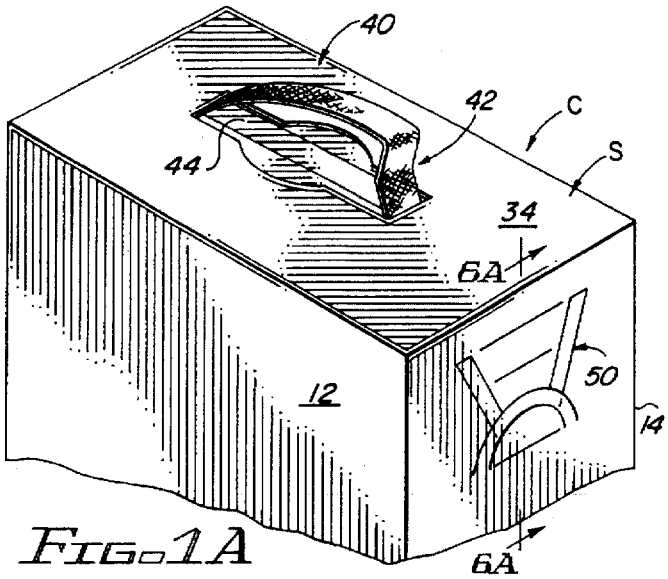
FIG. 1A is an isometric view of the upper portion of a carton with dispensing arrangement embodying features of the present invention, with the carton shown closed.
Figure 2:
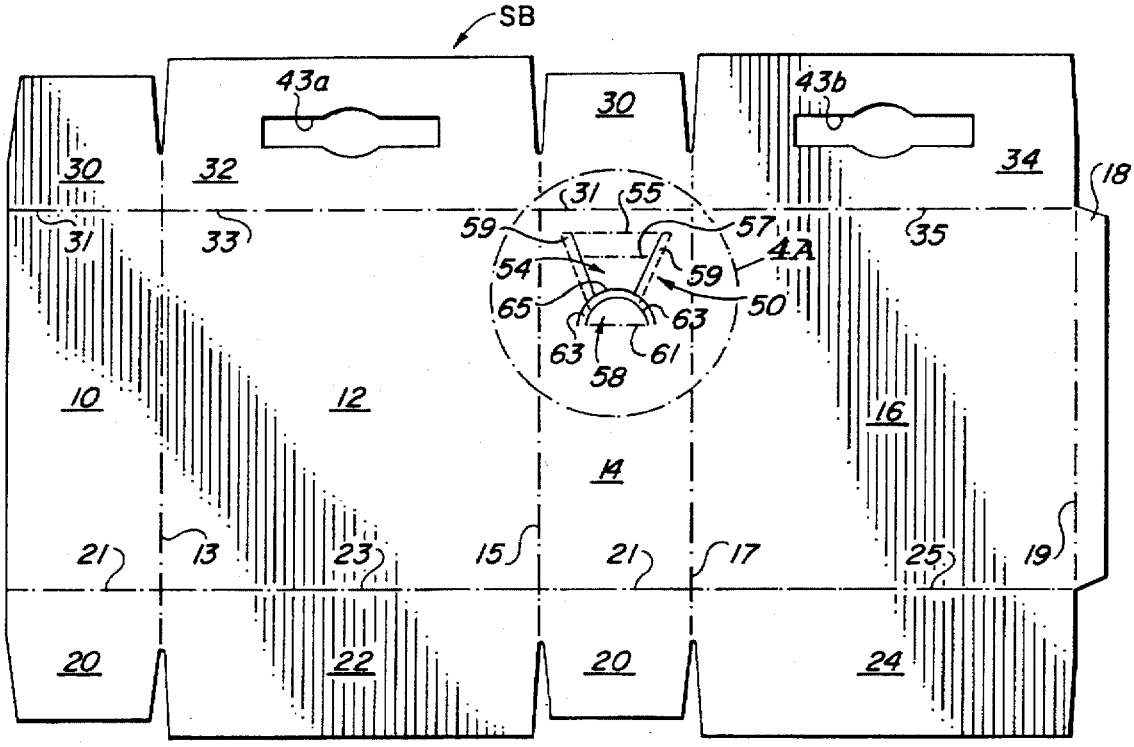
FIG. 2 is a plan view of a blank of sheet material from which the shell of the carton illustrated in the other views may be formed.
Figure 3:
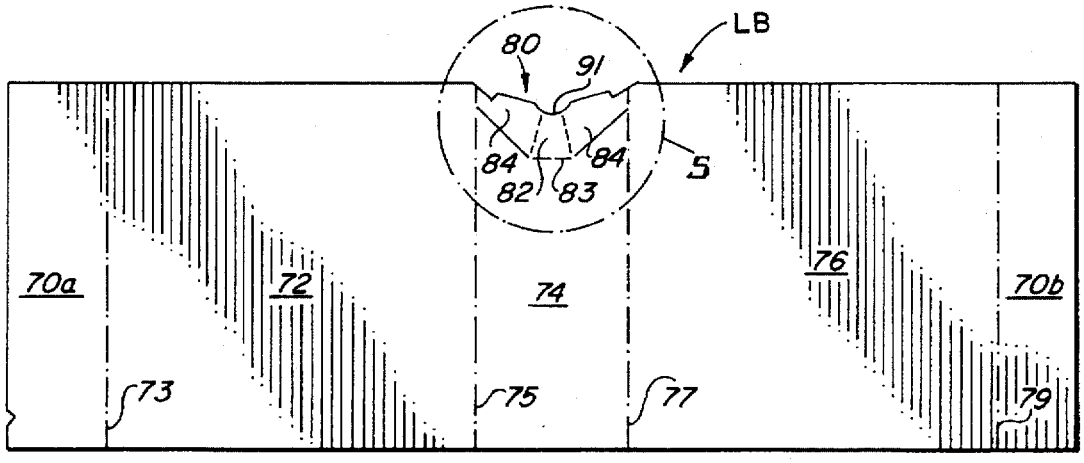
FIG. 3 is a plan view of a blank of sheet material from which the liner of the carton illustrated in the other views may be formed.
Figure 4A:
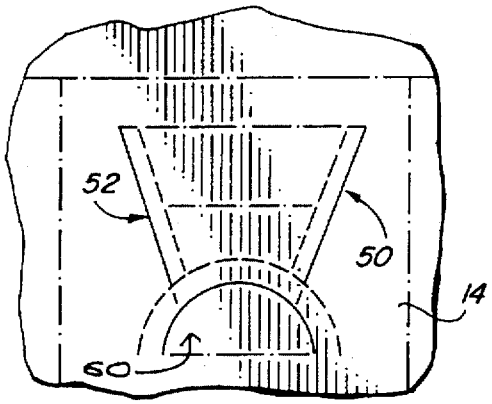
FIG. 4A is an enlarged view of a portion of the structure illustrated in FIG. 2.

Referring now to the drawings for a better understanding of the invention, it will be seen that the outer shell S of the composite carton, indicated generally at C in FIG. 1A, may be formed from the unitary blank SB of foldable sheet material, such as paperboard illustrated in FIG. 2; and liner L of the carton C may be formed from blank LB of sheet material shown in FIG. 3.

Figure 1B:
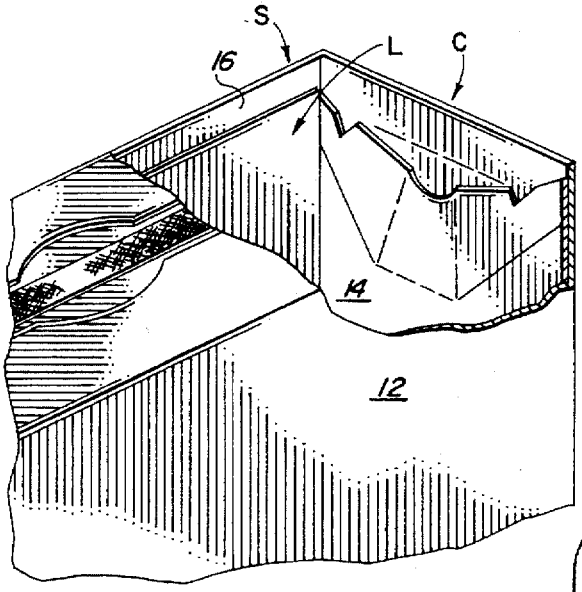
FIG. 1B is a view similar to that of FIG. 1, but with a portion of the carton top removed.

As best seen in FIGS. 1A and 1B, the carton outer shell S includes a first minor side wall panel 10, a first major side wall panel 12, a second minor side wall panel 14, a second major side wall panel 16, and a glue flap 18, which are foldably joined to each other along parallel fold lines 13, 15, 17, and 19.

The lower end of the carton shell may be closed by a pair of lower inner end flaps 20, foldably joined along fold lines 21 to lower ends of minor side wall panels 10 and 14; a lower intermediate end flap 22, foldably joined along a fold line 23 to the lower end of first major side wall panel 12; and a lower outer end flap 24, foldably joined along a fold line 25 to the lower end of second major side wall panel 16.

The lower end flaps may be folded over and adhesively secured to each other in overlapped relation.

In a similar manner the upper end of the carton shell may be closed by a pair of upper inner end flaps 30, foldably joined along fold lines 31 to upper ends of minor side wall panels 10 and 14; an upper intermediate end flap 32, foldably joined along a fold line 33 to the upper end of first major side wall panel 12; and an upper outer end flap 34, foldably joined along a fold line 35 to the upper end of second major side wall panel 16.

The upper end flaps may also be folded over and secured to each other in overlapped relation.

For larger cartons embodying features of the present invention, a handle arrangement, such as that indicated generally at 40, may be provided. It should be understood that the essential feature of the present invention is the sift-resistant, reclosable, dispensing opening structure with the pour spout formed by the carton liner, as described later herein. Other types of handle structures may be used for the carton if desired.

As best seen in FIGS. 1A and 2, the handle arrangement 40 includes a relatively narrow, thin, plastic strip 42 adapted to project upwardly out of the carton through openings **43*a* and 43*b* in the upper intermediate and outer closures flaps 32 and 34, respectively. End portions of strip 42 may be secured to the underside of intermediate closure flap 32 around the periphery of opening 41 by a relatively thin paperboard or plastic retaining strip 44**.

In order to accommodate the presence of the handle end portions and still maintain the upper closure flaps even and sift-proof, upper inner closure flaps may be debossed slightly, if desired, to provide slight depressions (not shown on the drawings).

As seen in FIGS. 1A, 2, 4A–4C, and 6A–6C, second minor side wall panel 14 is provided with a reclosable dispensing arrangement indicated at 50, which includes a somewhat key-hole or hour-glass shaped dispensing opening indicated generally at 51, that comprises adjacent communicating upper and lower portions.

Dispensing opening 51 may be closed by a two-piece dispensing closure flap member, indicated generally at 52, which comprises a pair of cooperating, separate, contiguous, upper and lower elements 54 and 60, respectively, which, when moved out of the plane of the side wall panel uncover the opening 51.

Upper element 54 is preferably in the shape of an inverted triangle, with the lower end cut off. Upper element 54 includes an upper section 56, foldably joined at its upper edge along a fold line 55 to second minor side wall 14 adjacent the upper end thereof, and a lower section 58, foldably joined at its upper edge along fold line 57 to a lower edge of upper section 56.

Upper element 54 is defined partly by the fold line 55 and a pair of vertical lines of weakness 59 that extend downwardly from the ends of fold line 55.

Lower element 60 is preferably in the form of a semicircle and is foldably joined at its lower edge along a fold line 61 to second minor side wall panel 14. Lower element 60 is partly defined by the fold line 61 and a pair of lines of weakness 63 that extend upwardly from the ends of fold line 61.

As seen in FIG. 4, adjacent ends of lines 59 and 63 are joined by a common line of weakness 65. All the lines of weakness are formed by parallel cuts from opposite sides of the paperboard.

Turning now to FIGS. 1B, 3, 4A–4C, and 5, it will be seen that a separate liner L is provided for the shell S. Liner L may be formed from the unitary paperboard blank LB shown in FIG. 3.

Liner L includes a first minor panel first section 70*a*, a first major panel 72, a second minor panel 74, a second major panel 76, and a first minor panel second section 70*b* which are foldably joined to each other along parallel fold lines 73, 75, 77, and 79.

When the carton C is formed liner blank LB is placed against the inside surface of shell blank SB, as shown in FIG. 1B, with portions of the liner adhesively secured to adjacent portions of the shell. Preferably the major panels of the liner are secured to the major side wall panels of the shell, and related minor panels of the liner and minor side wall panels of the shell are free from attachment to each other.

An essential feature of the invention is the unique pour spout arrangement, wherein the carton pour spout is actually formed by the carton liner. As best seen in FIGS. 1B, 3, 4B, 4C, 5, and 6C, the pour spout structure, indicated generally at 80, is formed from material of the upper end of liner second minor side wall panel 74.

Figure 5:
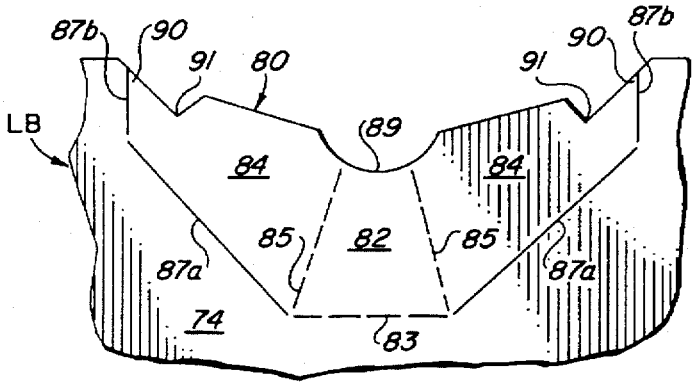
FIG. 5 is an enlarged view of a portion of the structure illustrated in FIG. 3.

As best seen in FIG. 5, pour spout structure 80 includes a center section 82 and a pair of side sections 84.

Center section 82 is foldably joined, at its lower edge along a generally horizontally extending fold line 83, to liner second minor side wall panel 74. Side sections 84 are foldably joined, along fold lines 85 to opposed side edges of center section 82, and are separated from side wall panel 74 by first cut lines 87*a*, that extend diagonally upward and outward from opposite ends of fold line 83, and second cut lines 87*b* that extend vertically upward from the upper ends of diagonal cut lines 87*a* to the upper edge of the liner.

The upper edges of pour spout center and side sections 82 and 84 are provided with an arcuate recess 89 to facilitate grasping of the pour spout to pull it out of the carton shell, as described later herein.

The upper corners of pour spout side sections 84 are provided with upwardly projecting locking ears 90 which are formed by recesses 91 formed in the upper edges of sections 84. The purpose of the locking ears is to engage the liner side wall panel 74, when the pour spout is being pulled out of the carton shell to dispense contents of the carton, and thereby prevent the pour spout from being pulled too far out of the carton.

After the carton shell S and liner L have been attached to each other, the carton can then be formed, filled, and closed.

To open the carton, first the closure flap member lower element 60 is pushed inwardly a sufficient amount to separate element 60 from shell second minor side wall panel 14 and from upper element upper section 56.

Figure 4B:
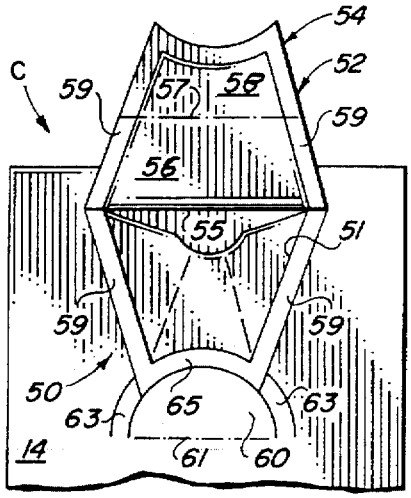
FIG. 4B is a partial end elevational view of the upper portion of the structure illustrated in FIG. 1A, with the closure flap shown in an open position.
Figure 6A:
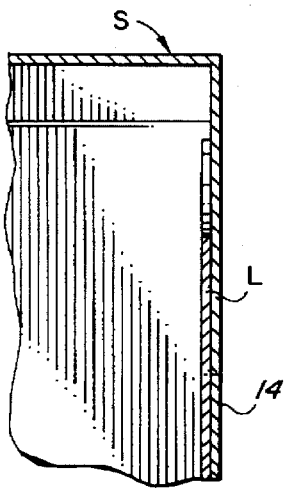
FIG. 6A is a partial vertical sectional view taken on line 6A—6A of FIG. 1A.
Figure 6B:
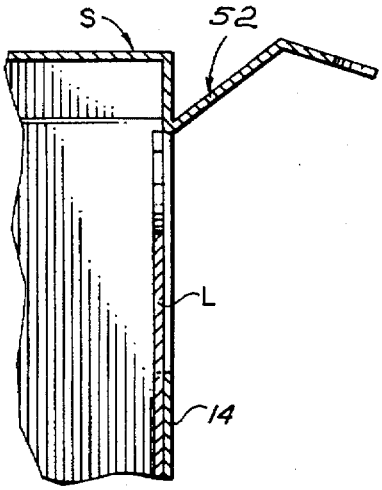
FIG. 6B is a view similar to that of FIG. 6A, but with the closure flap upper element shown in an open position.

Then both sections of upper element 54 are lifted or pulled away from the carton shell side wall panel 14, as shown in FIGS. 4B and 6B, to expose the upper portion of dispensing opening 51.

It will be seen that the lower portion of the opening 51 is covered by the adjacent minor panel 74 of the liner L, so that, as a practical matter, product will be dispensed from the carton through the upper portion of opening 51 by means of the pour spout.

Figure 4C:
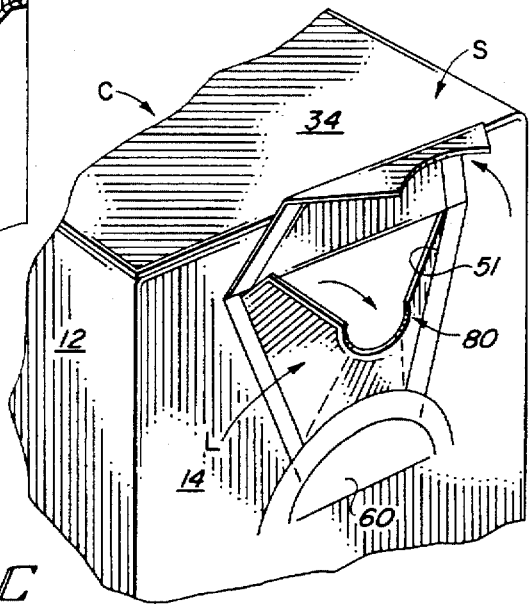
FIG. 4C is a view similar to that of FIG. 4B, but with the pour spout shown pulled out to a fully open position.
Figure 6C:
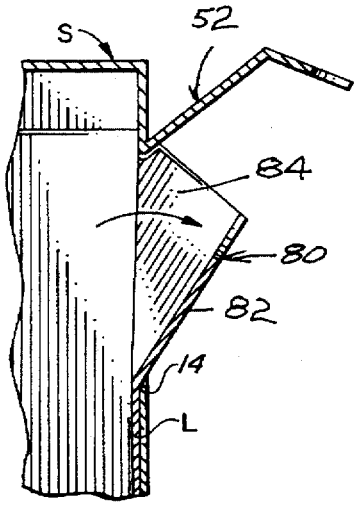
FIG. 6C is a view similar to that of FIG. 6B, but with the pour spout shown pulled out to a fully open position.

After the upper portion of opening 51 is exposed, one can insert a finger into the carton to grasp the pour spout upper edge at finger recess 89 and pull the pour spout 80 out of the carton shell a distance sufficient to allow the use of the pour spout to dispense product from the carton, as shown in FIGS. 4C and 6C. As previously mentioned, ears 90 engage the shell side wall panel 74 to prevent the pour spout from being pulled too far out of the carton shell.

In order to reclose the carton, after product has been dispensed therefrom, the pour spout structure 80 is first pushed back into the carton shell. The closure flap upper element 54 can then be folded downwardly and its lower section 58 tucked into the carton behind the upper edge of closure flap lower element 60.

In this way the upper portion of opening 51 is covered by the upper section 56 of the upper element 54, while the remaining portion of the opening 51 is covered by the lower element 60 and adjacent minor panel 74 of the liner L to provide a relatively simple and economical package with a movable pour spout and a reclosable dispensing opening.

What is claimed:

1. A two-piece carton with a sift-resistant opening feature and reclosable dispensing feature, said carton comprising:

(a) a shell including opposed major and minor side wall panels foldably joined to each other to form an outer tubular structure open at the ends;

(b) upper and lower end flaps foldably joined to upper and lower ends of said side wall panels and secured to each other in overlapped relationship to close said structure open ends;

(c) one of said shell minor side wall panels having, extending therethrough adjacent an upper end thereof, a dispensing opening covered by a pair of contiguous, partially detachable reclosable, upper and lower, closure flaps foldably joined to said one side wall panel adjacent said dispensing opening;

(d) a liner including opposed major and minor side wall panels foldably joined to each other to form an inner tubular structure positioned within said shell;

(e) one of said liner minor side panels being positioned against an inner surface of said shell one minor side wall panel;

(f) said liner one side panel including an integral pour spout located adjacent said shell dispensing opening, arranged and disposed to be pulled part way out of the carton through said dispensing opening;

(g) said liner pour spout comprising:

(i) a center section having a lower edge foldably joined to a remaining portion of said liner one side panel;

(ii) a pair of side sections foldably joined to opposed side edges of said center section and free from attachment to said liner one side panel remaining portion;

(h) said upper closure flap including:

(i) an upper section foldably joined at its upper edge to said shell one major side wall panel, along a first fold line; and (ii) a lower section joined at its upper edge to a lower edge of said upper section, along a second fold line that is parallel to said first fold line;

(iii) both of said upper closure flap sections being detachably joined to said shell one side wall panel by a pair of separate, laterally spaced, generally vertically extending, upper lines of weakness extending downwardly from opposite ends of said first fold line;

(i) said lower closure flap being foldably joined to said shell one minor side wall panel along a third fold line, extending parallel to said first and second fold lines, and being detachably joined to said one end wall by a pair of laterally spaced, generally vertically extending, separate, lower lines of weakness extending upwardly from opposite ends of said second fold line;

(j) said lower section being detachably joined to said lower flap by a common, central line of weakness that extends between adjacent ends of said upper and lower lines of weakness;

(k) said lower flap being arranged and disposed to be pushed inwardly to partially detach it from said one end wall and said upper flap to allow insertion of a finger to grasp said pour spout.

2. A carton according to claim 1, wherein said pour spout center section includes a recess in an upper edge thereof to facilitate grasping of the pour spout by a finger.

3. A carton according to claim 1, wherein said pour spout side sections each includes a projection extending upwardly from an outer corner thereof for engagement with said shell one minor side wall panel to prevent said pour spout from accidentally being pulled too far out of said shell.

4. A carton according to claim 1, wherein said upper flap is generally pie-shaped.

5. A carton according to claim 1, wherein said lower closure flap is arcuate in shape.

6. A carton according to claim 1, wherein said upper lines of weakness converge downwardly.

7. A carton according to claim 1, wherein said lines of weakness are formed by double cut scores.

8. A two-piece carton with a sift-resistant opening feature and reclosable dispensing feature, said carton comprising:

(a) a shell including opposed major and minor side wall panels foldably joined to each other to form an outer tubular structure open at the ends;

(b) upper and lower end flaps foldably joined to upper and lower ends of said side wall panels and secured to each other in overlapped relationship to close said structure open ends;

(c) one of said shell minor side wall panels having, extending therethrough adjacent an upper end thereof, a dispensing opening covered by a pair of contiguous, partially detachable reclosable, upper and lower, closure flaps foldably joined, along parallel fold lines, to said one side wall panel adjacent said dispensing opening;

(d) a liner including opposed major and minor side wall panels foldably joined to each other to form an inner tubular structure positioned within said shell;

(e) one of said liner minor side panels being positioned against an inner surface of said shell one minor side wall panel;

(f) said liner one side panel including an integral pour spout located adjacent said shell dispensing opening, arranged and disposed to be pulled part way out of the carton through said dispensing opening;

(g) said liner pour spout comprising:

(i) a center section having a lower edge foldably joined to a remaining portion of said liner one side panel;

(ii) a pair of side sections foldably joined to opposed side edges of said center section and free from attachment to said liner one side panel remaining portion;

(h) said lower closure flap being arranged and disposed to be pushed inwardly to partially detach it from said one end wall and said upper flap, to allow insertion of a finger to grasp said upper closure flap to lift it, and to grasp said pour spout to and pull it part way out of said shell.

9. A carton according to claim 8, wherein said pour spout center section includes a recess in an upper edge thereof to facilitate grasping of the pour spout by a finger.

10. A carton according to claim 8, wherein said pour spout side sections each includes a projection extending upwardly from an outer corner thereof for engagement with said shell one minor side wall panel to prevent said pour spout from accidentally being pulled too far out of said shell.

11. A carton according to claim 8, wherein said upper flap is generally pie-shaped.

12. A carton according to claim 8, wherein said lower closure flap is arcuate in shape.

13. A carton according to claim 8, wherein said upper closure flap is detachably joined to said shell one side wall by a pair of separate, laterally spaced, generally vertically extending, downwardly converging, upper lines of weakness extending downwardly from opposite ends of a fold line joining said upper closure flap to said shell one side wall.

14. A carton according to claim 13, wherein said lines of weakness are formed by double cut scores.

15. A carton according to claim 8, wherein said lower closure flap is detachably joined to said shell one side wall by a pair of separate, laterally spaced, lower lines of weakness extending upwardly from opposite ends of a fold line joining said upper closure flap to said shell one side wall.

16. A carton according to claim 15, wherein said lines of weakness are formed by double cut scores.

17. A carton according to claim 8, wherein said lower closure flap is detachably joined to upper closure flap by an arcuate line of weakness extending laterally between adjacent ends of said upper and lower lines of weakness.

18. A two-piece carton with a sift-resistant opening feature and reclosable dispensing feature, said carton comprising:

(a) a shell including opposed major and minor side wall panels foldably joined to each other to form an outer tubular structure open at the ends;

(b) upper and lower end flaps foldably joined to upper and lower ends of said side wall panels and secured to each other in overlapped relationship to close said structure open ends;

(c) one of said shell minor side wall panels having, extending therethrough adjacent an upper end thereof, a dispensing opening covered by at least one partially detachable reclosable, closure flap foldably joined to said one side wall panel adjacent said dispensing opening;

(d) a liner including opposed major and minor side wall panels foldably joined to each other to form an inner tubular structure positioned within said shell;

(e) one of said liner minor side panels being positioned against an inner surface of said shell one minor side wall panel;

(f) said liner one side panel including an integral pour spout located adjacent said shell dispensing opening, arranged and disposed to be pulled part way out of the carton through said dispensing opening;

(g) said liner pour spout comprising:

(i) a center section having a lower edge foldably joined to a remaining portion of said liner one side panel;

(ii) a pair of side sections foldably joined to opposed side edges of said center section and free from attachment to said liner one side panel remaining portion;

(h) said closure flap being arranged and disposed to be pushed inwardly to partially detach it from said one end wall and said upper flap, to allow insertion of a finger to grasp said pour spout and pull it part way out of said shell.

19. A carton according to claim 18, wherein said pour spout center section includes a recess in an upper edge thereof to facilitate grasping of the pour spout by a finger.

20. A carton according to claim 18, wherein said pour spout side sections each includes a projection extending upwardly from an outer corner thereof for engagement with said shell one minor side wall panel to prevent said pour spout from accidentally being pulled too far out of said shell.

* * * * *